US010267328B2

(12) United States Patent
Kondratek et al.

(10) Patent No.: US 10,267,328 B2
(45) Date of Patent: Apr. 23, 2019

(54) ROTOR STRUCTURE FOR ROTATING MACHINERY AND METHOD OF ASSEMBLY THEREOF

(71) Applicant: Rolls-Royce Corporation, Indianapolis, IN (US)

(72) Inventors: Joseph Kondratek, Derby (GB); Guy Gualtieri, Palm Beach Gardens, FL (US); Jonathan P. Acker, Westfield, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 994 days.

(21) Appl. No.: 14/805,190

(22) Filed: Jul. 21, 2015

(65) Prior Publication Data

US 2017/0022998 A1 Jan. 26, 2017

(51) Int. Cl.

| | |
|---|---|
| ***F04D 29/054*** | (2006.01) |
| ***F04D 17/10*** | (2006.01) |
| ***F04D 19/02*** | (2006.01) |
| ***F04D 29/26*** | (2006.01) |
| ***F01D 5/02*** | (2006.01) |
| ***F01D 5/06*** | (2006.01) |

(52) U.S. Cl.

CPC ..... *F04D 29/054* (2013.01); *F01D 5/025* (2013.01); *F01D 5/066* (2013.01); *F04D 17/10* (2013.01); *F04D 19/02* (2013.01); *F04D 29/266* (2013.01); *F05D 2230/60* (2013.01)

(58) Field of Classification Search

CPC ..... F04D 29/054; F04D 29/266; F01D 5/025; F01D 5/066; F05D 2230/60

See application file for complete search history.

(56) References Cited

U.S. PATENT DOCUMENTS

| | | | | |
|---|---|---|---|---|
| 4,578,942 | A | 4/1986 | Weiler | |
| 4,719,747 | A | 1/1988 | Willkop et al. | |
| 5,025,629 | A | 6/1991 | Woollenweber | |
| 5,180,281 | A * | 1/1993 | Burge | F01D 9/00 415/209.2 |
| 5,267,397 | A | 12/1993 | Wilcox | |
| 7,431,561 | B2 | 10/2008 | Hooper et al. | |
| 7,431,562 | B2 | 10/2008 | Hooper et al. | |
| 7,510,380 | B2 * | 3/2009 | Alam | F01D 5/025 416/244 A |
| 7,571,607 | B2 * | 8/2009 | Vrbas | F01D 17/162 415/69 |
| 7,683,497 | B2 | 3/2010 | Gozdawa | |
| 7,766,607 | B2 | 8/2010 | Charier et al. | |
| 8,387,357 | B2 | 3/2013 | Jewess et al. | |
| 8,414,249 | B2 | 4/2013 | Nikpour | |
| 8,508,062 | B2 | 8/2013 | Gozdawa | |
| 2012/0189431 | A1 | 7/2012 | Gingtcr et al. | |

(Continued)

*Primary Examiner* — Richard A Edgar
*Assistant Examiner* — Michael L Sehn
(74) *Attorney, Agent, or Firm* — McCracken & Gillen LLC

(57) ABSTRACT

According to one aspect, a rotor structure and method of assembling a rotor structure for rotating machinery include a first rotor portion assembled on a tie bolt in abutment with a stop surface and a fastener assembled on the tie bolt at a second axial location spaced from the first axial location to capture the first rotor portion on the tie bolt between the first and second axial locations. A second rotor portion is secured on the tie bolt in abutment with a second stop surface spaced from the first stop surface.

19 Claims, 6 Drawing Sheets

(56) References Cited

U.S. PATENT DOCUMENTS

| | | | | |
|---|---|---|---|---|
| 2013/0028724 | A1 | 1/2013 | Lange et al. | |
| 2013/0058761 | A1 | 3/2013 | Nass et al. | |
| 2013/0189094 | A1 | 7/2013 | Nikpour | |
| 2013/0192231 | A1 | 8/2013 | Buehler et al. | |
| 2014/0023487 | A1* | 1/2014 | Dougan | F01D 25/243 415/144 |

* cited by examiner

ROTOR STRUCTURE FOR ROTATING MACHINERY AND METHOD OF ASSEMBLY THEREOF

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

FIELD OF DISCLOSURE

The present subject matter relates to rotating machinery, and more particularly, to a rotor structure and assembly method therefor.

BACKGROUND

Rotating machines, such as turbomachinery, have rotating parts that are assembled within stationary parts and which must be precisely positioned therein. For example, a compressor system may include a multi-stage axial compressor module in series with a single-stage radial compressor module. A rotor structure for such a compressor may include one or more tie bolts on which axial compressor and radial compressor components are mounted. In some types of machines, the separate axial and radial compressor components are disposed within separate stationary housings and challenges are faced because of interfering structures that are encountered during an assembly sequence.

Further, there is often a need to secure multiple rotor structures disposed on a common rotor with different loadings. Thus, in the previous example, the axial compressor rotor components may require assembly onto the tie bolt(s) with a first axial load magnitude whereas the radial compressor rotor components may require a second, different, axial load magnitude to assemble to the same tie bolt(s).

Still further, there are instances in which it may be necessary or desirable to disassemble a portion of the components mounted on the rotor without disturbing the remaining components. Thus, for example, one may wish to remove the radial compressor rotor components in the preceding example machine without disturbing (e.g., unseating) radial pilots of the axial compressor rotor module.

It is well known that rotating parts can produce vibrations that should be minimized in order to achieve efficient and satisfactory operation. The complex positioning of parts, however, can make it difficult to use additional supports that minimize such vibrations, and the use of supports can further complicate the assembly/disassembly process.

SUMMARY

According to one aspect, a rotor structure for rotating machinery includes first and second rotor portions and a tie bolt having a first stop surface at a first axial location wherein the first rotor portion is disposed on the tie bolt in abutment with the stop surface. A fastener is disposed on the tie bolt at a second axial location spaced from the first axial location to capture the first rotor portion on the tie bolt between the first and second axial locations. The second rotor portion is disposed on the tie bolt in abutment with a second stop surface spaced from the first stop surface.

According to another aspect, a rotor structure for rotating machinery comprises a tie bolt having a first stop surface at a first axial location and a first rotor portion disposed on the tie bolt in abutment with the stop surface. A first fastener is disposed on the tie bolt at a second axial location spaced from the first axial location and engages the first rotor portion to capture the first rotor portion on the tie bolt between the first and second axial locations, wherein the fastener includes a second stop surface. A second rotor portion is disposed on the tie bolt in abutment with the second stop surface. A second fastener is disposed on the tie bolt at a third axial location spaced from the first and second axial locations and engages the second rotor portion to capture the second rotor portion on the tie bolt between the second and third axial locations. A support is coupled to the tie bolt proximate the second axial location.

According to yet another aspect, a method of assembling a rotor structure for rotating machinery comprises the steps of providing first and second rotor portions and providing a tie bolt having a first stop surface at a first axial location. The first rotor portion is assembled on the tie bolt in abutment with the stop surface and a fastener is assembled on the tie bolt at a second axial location spaced from the first axial location to capture the first rotor portion on the tie bolt between the first and second axial locations. The second rotor portion is secured on the tie bolt in abutment with a second stop surface spaced from the first stop surface.

Other aspects and advantages will become apparent upon consideration of the following detailed description and the attached drawings wherein like numerals designate like structures throughout the specification.

DETAILED DESCRIPTION

Figure 1:
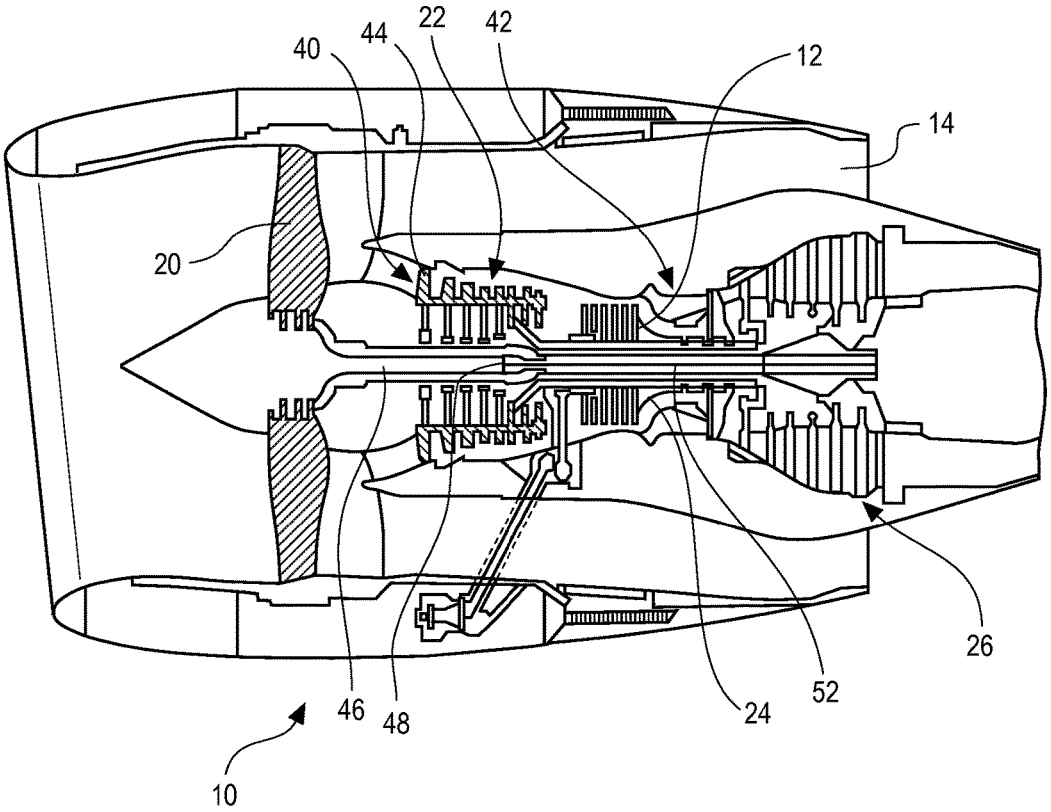
FIG. 1 is a cross sectional view of an exemplary rotating machine in the form of a gas turbine engine.

Referring to FIG. 1, rotating machinery 10 includes a rotor structure 12 mounted for rotation within a stator 14. It should be noted that the embodiments disclosed herein may be used in or with any rotating machinery having a rotating member, such as a gas turbine engine or other turbomachinery including a turbofan engine, a turbojet engine, a jet prop engine, etc., as well as non-turbomachinery such as a stand-alone compressor, a pump, a generator, a motor, or the like.

The engine 10 includes a fan 20 mounted on a shaft, a compressor section 22 in fluid communication with the fan 20, a combustion chamber 24 that receives compressed air from the compressor section 22 as well as a combustible fuel, and a turbine section 26 that converts rapidly expanding combusting fuel and air into rotary motive power. At least the elements of the compressor section 22 are mounted on a tie bolt 30 seen in the various FIGS.

Figure 5:
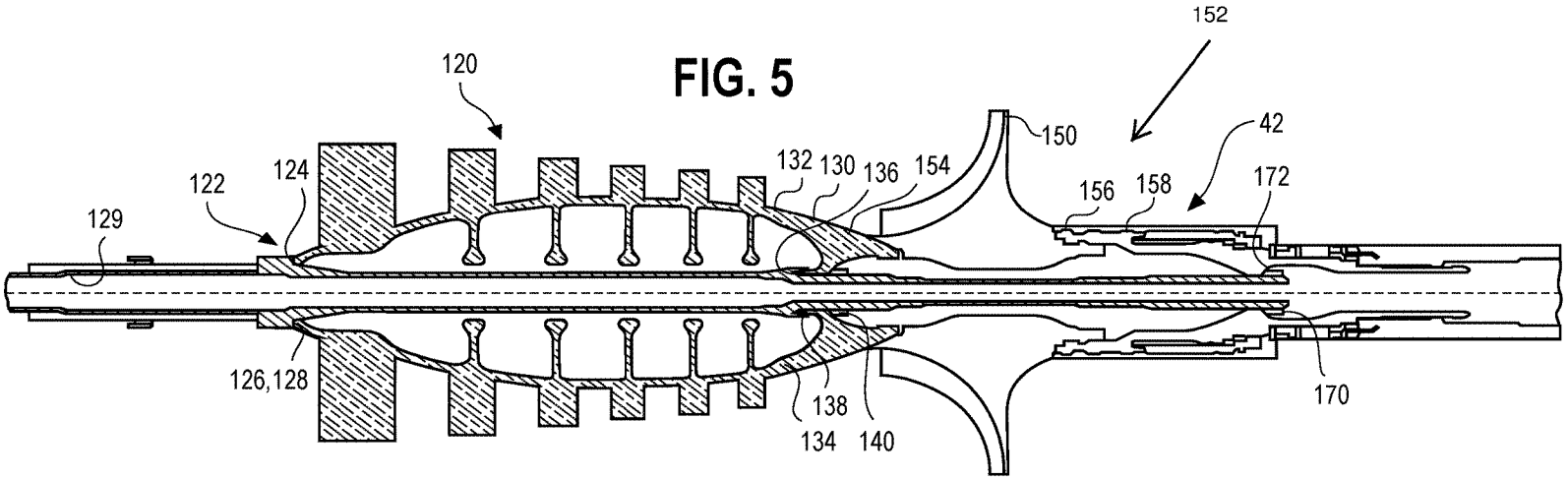
FIG. 5 is a cross sectional view of a specific rotor structure of a further exemplary rotating machine comprising a compressor.

The compressor section 22 may be of any suitable type, such as a combined axial and radial flow compressor including a first or axial portion 40 and a second or radial portion 42 (for example, as also shown specifically in FIG. 5). The axial portion 40 may include rotating blades 44 carried by a first portion 46 of a rotor backbone structure 48. The axial portion 40 may have any number of stages; FIG. 1 shows an eight-stage portion 40 whereas FIG. 5 illustrates a six-stage portion 40. The radial portion 42 may include an impeller 150 (as depicted in FIG. 5) carried by a second portion 52 of the rotor backbone structure 48.

Figure 2:
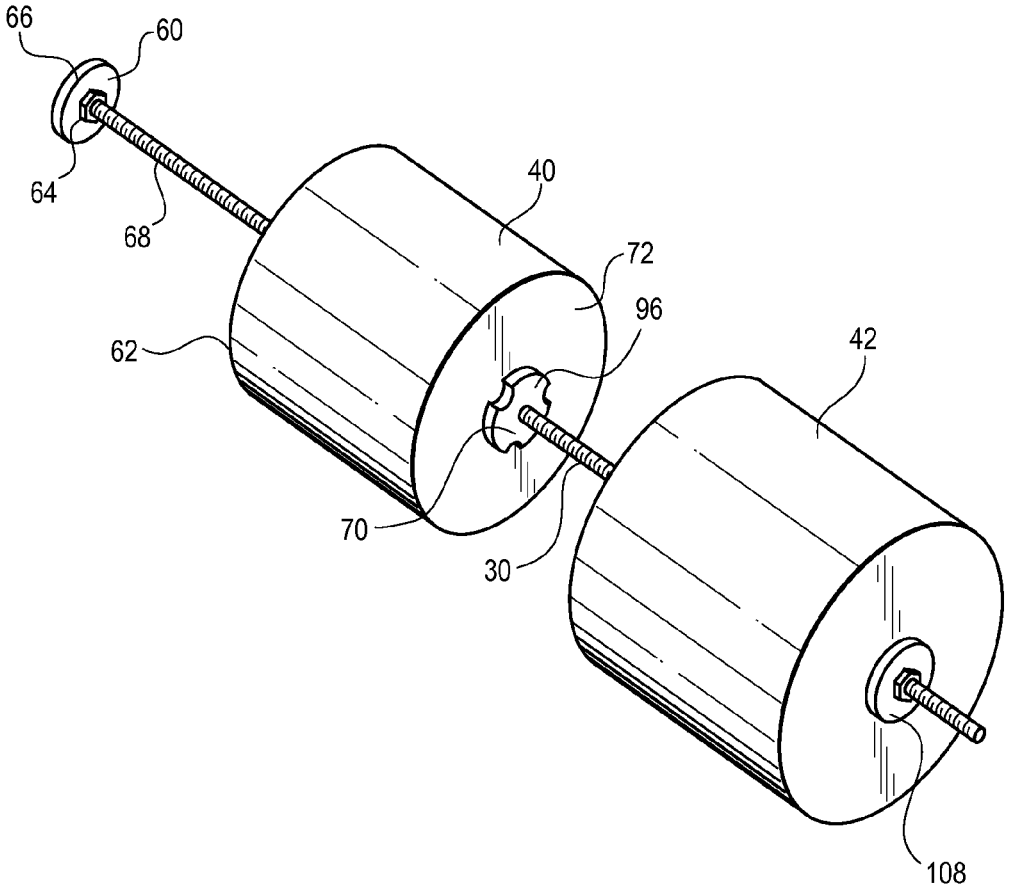
FIG. 2 is a simplified isometric view of a portion of a rotor structure of a rotating machine during an assembly sequence thereof.
Figure 4:
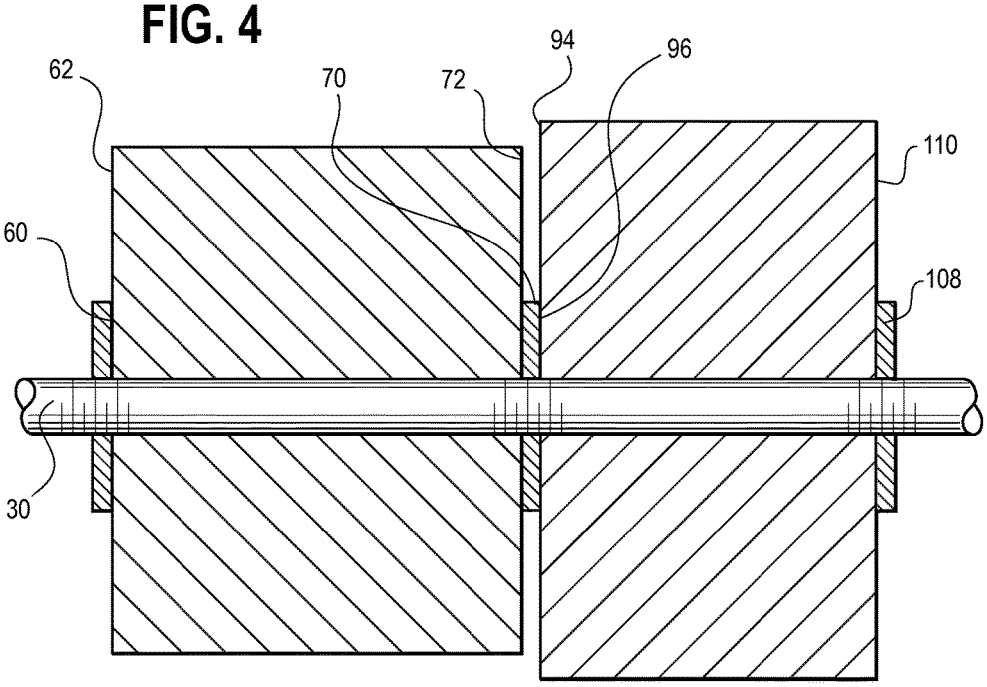
FIG. 4 is a simplified cross sectional view of the rotor structure of FIG. 2 after completion of the assembly sequence.

FIGS. 2 and 4 illustrate an assembly sequence that may be undertaken to assemble the forward axial compressor portion 40 and the aft radial compressor portion 42 on the tie bolt 30. The portions 40, 42 are only generally shown in such FIGS. to simplify an initial description. The tie bolt 30 includes a first stop surface 60 disposed at a first axial location of the tie bolt 30. The first stop surface 60 may simply comprise a shoulder or other interfering structure that presents a seating surface for a first end surface 62 of the axial compressor portion 40 to engage. Alternatively, the first stop surface 60 may be of any other suitable shape and construction, and, for example, may comprise a nut 64 secured by one or more welds to a washer 66. The nut 64 may have internal threads that interengage external threads 68 of the tie bolt 30. The nut is threaded onto the tie bolt 30 until the washer 66 is disposed at the first axial location. The nut 64 may be simply left at such location or the nut 64 and/or the washer 66 may be secured to the tie bolt by one or more welds. In a still further alternative, the washer 66 may be omitted, in which case the end surface 62 may engage the nut 64. A further alternative embodiment may provide the stop surface 60 as an integral portion of the tie bolt 30 optionally formed during the manufacture of the tie bolt 30. In any event, the axial compressor portion 40 is assembled on the tie bolt 30 and is moved into engagement with the stop surface 60.

A next step in the assembly sequence is to assemble a fastener 70 onto the tie bolt 30 and to move the fastener 70 until the fastener 70 engages a second end surface 72 of the axial compressor portion 40. The fastener 70 may comprise a threaded spanner nut having internal threads that interengage with external threads of the tie bolt 30. The fastener 70 is threaded onto the tie bolt 30 until the fastener 70 engages the second end surface 72. Typically, the fastener 70 is tightened against the end surface 72 until a particular torque magnitude is reached and the fastener 70 exerts a first force magnitude against the end surface 72.

Figure 6:
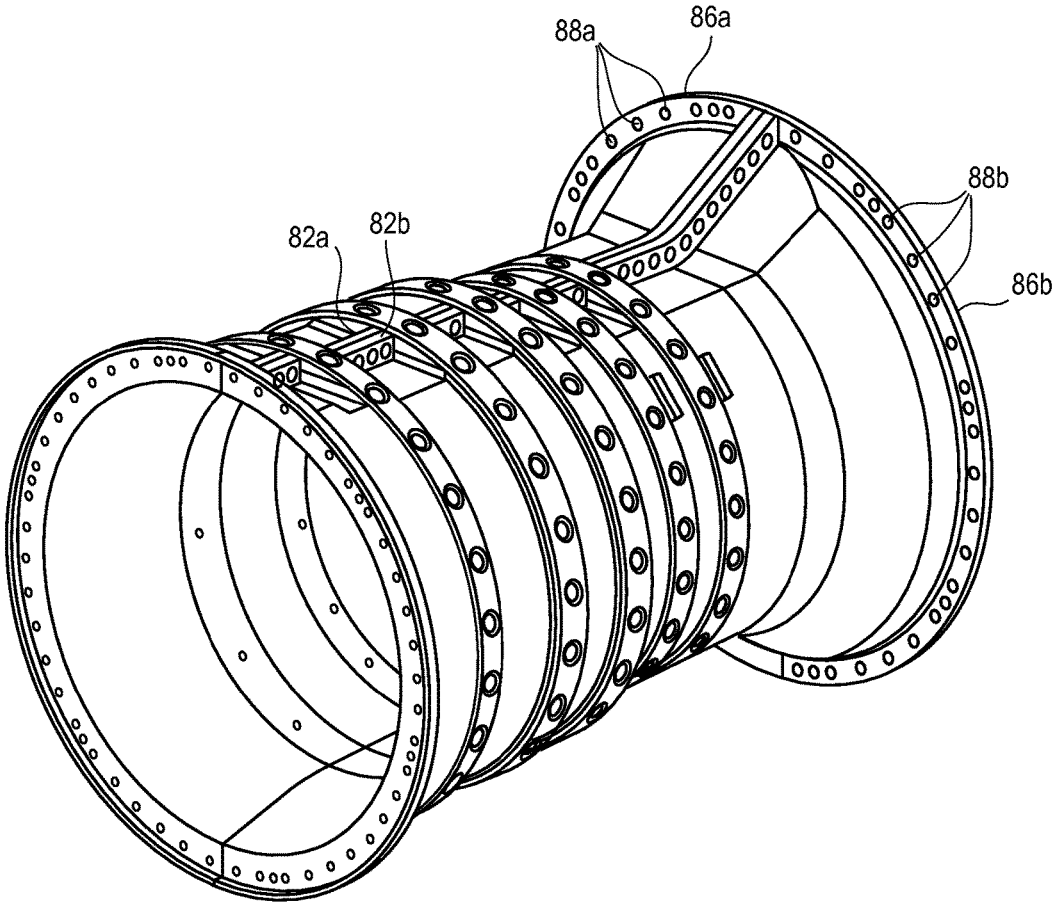
FIG. 6 is an isometric view of a compressor case.
Figure 7:
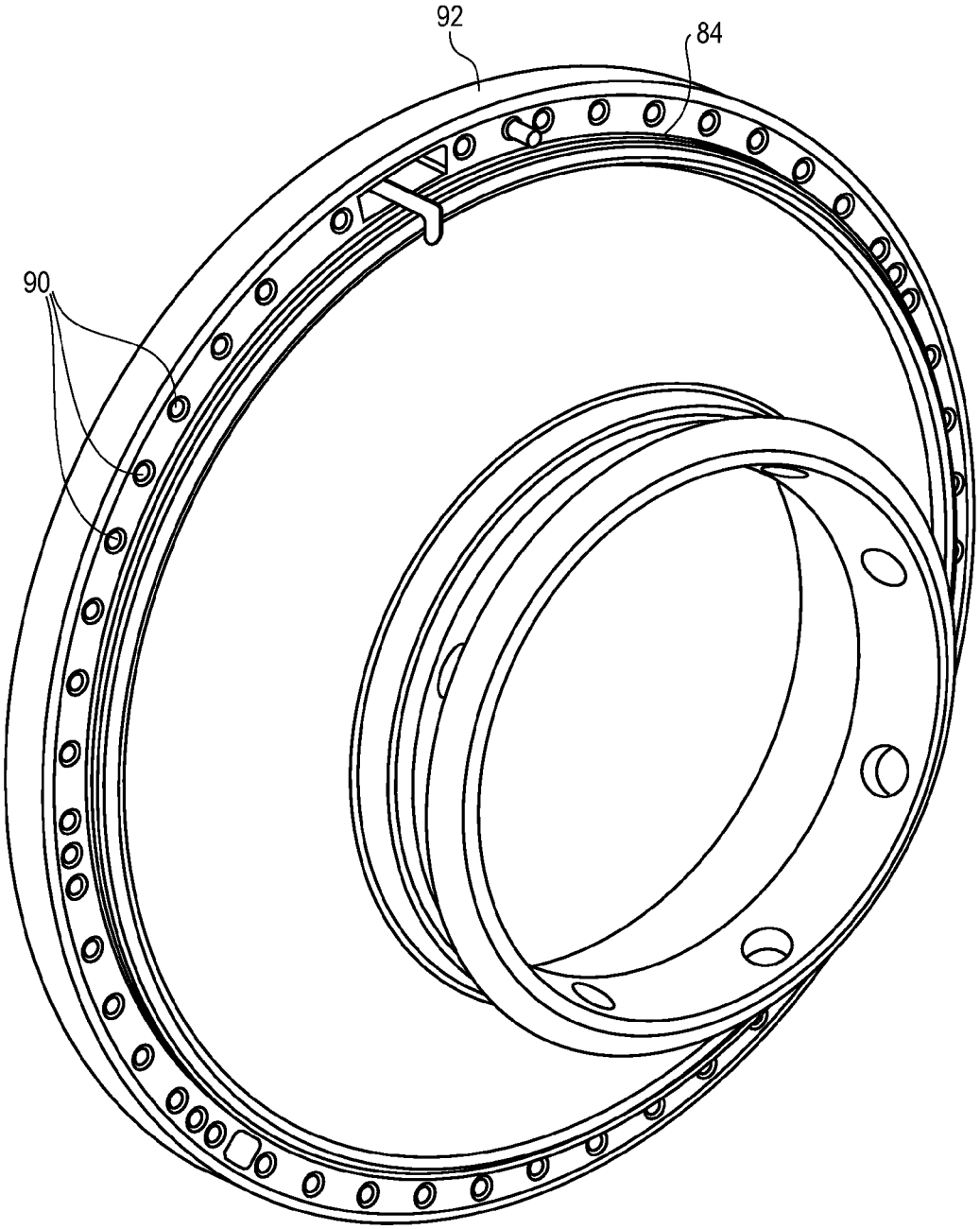
FIG. 7 is an isometric view of an impeller shroud.

Once the fastener 70 is tightened to the specified torque magnitude, an axial portion split compressor case 80 is assembled about the axial compressor portion 40. Specifically first and second case portions 82*a*, 82*b* (diagrammatically shown in FIG. 3) are bolted to one another about the portion 40 to enclose same. The compressor case 80 is shown alone in FIG. 6. Thereafter, a full hoop (i.e., a continuous 360 degree) impeller shroud 84, as seen in FIG. 7, is bolted to the first and second case portions 82*a*, 82*b* using bolts that extend through bores 88*a*, 88*b* in annular flange portions 86*a*, 86*b* of the case portions 82*a*, 82*b*, respectively, and aligned bores 90 in an annular flange 92 of the impeller shroud 84.

A next step of the assembly sequence comprises assembling the radial compressor portion 42 on the tie bolt 30 within the impeller shroud 84 and moving the radial compressor portion 42 until a first end surface 94 of the radial compressor portion 42 engages a second stop surface 96. In one embodiment, the second stop surface comprises the fastener 70, although in other embodiments, the second stop surface 96 is similar or identical to the first stop surface 60 and comprises a shoulder or other feature (e.g., a nut welded to a washer, a nut alone, etc.) carried by or formed in the tie bolt 30 or in another structure. A second fastener 108, which may be similar or identical to the first fastener 70 and thus may comprise a spanner nut, includes internal threads that interengage with external threads of the tie bolt 30 and the fastener 108 is threaded onto the tie bolt 30 until the fastener 108 engages a second end 110 of the radial compressor portion 42. The fastener 108 may then be tightened to a second torque magnitude that results in application of a second force magnitude on the radial compressor portion 42. The first torque magnitude and the first force magnitude may be the same or different than the second torque magnitude and the second force magnitude, respectively.

Figure 5A:
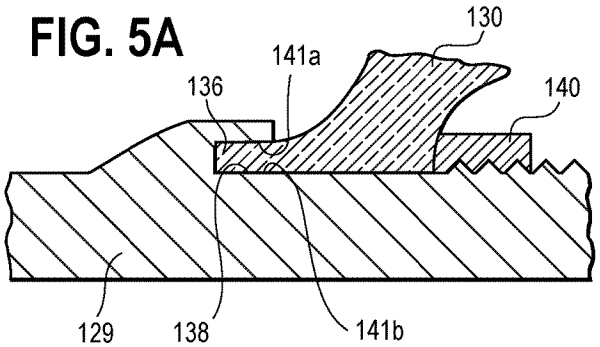
FIG. 5A is an enlarged, fragmentary, cross-sectional view of a portion of the rotor structure of FIG. 5.

FIG. 5 illustrates a specific application of the general features described above in connection with FIGS. 2-4. A six-stage axial compressor 120 includes a first rotor backbone portion 122 having a first end 124 that abuts a shoulder 126 comprising a first stop surface 128 of a tie bolt 129. An annular transition disk 130 includes an annular engagement surface 132 that is contacted and engaged by an annular aft portion 134 of the rotor backbone portion 122. The transition disk 130 further includes a flat annular foot 136 that is received within an annular recess 138 of the tie bolt 129. A fastener 140 comprising a spanner nut is secured on an aft side of the foot 136 by interengaging threads of the tie bolt 129 and the fastener 140 into engagement with the foot 136. The fastener 140 is tightened to a torque magnitude sufficient to exert approximately 60,000 pounds of axial force on the transition disk 130. This force is transmitted through the rotor backbone portion 122 against the first stop surface 128 to maintain the position of the rotor backbone portion 122 and the compressor members carried thereby on the tie bolt 129. The annular foot 136 engages surfaces 141*a*, 141*b* defining the flat radial recess 138 (FIG. 5A) to prevent substantial radial deflection of the tie bolt 129 at a mid-portion thereof so that vibrational modes of the tie bolt 129 are prevented from occurring.

Figure 3:
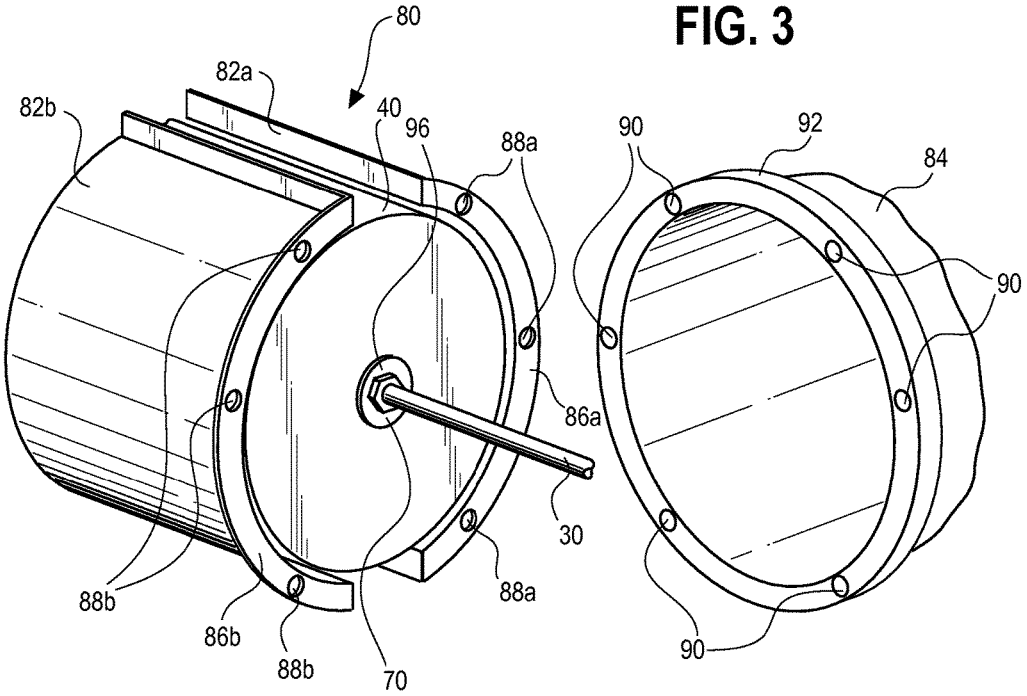
FIG. 3 is an exploded isometric view of the rotor structure of FIG. 2 at a later point in the assembly sequence.

Once the foregoing components are assembled, the axial portion split compressor case 80 and the full hoop impeller shroud 84 of FIG. 3 are assembled about the tie bolt 129 as described above. The assembled components, including the compressor section 22 and the tie bolt 30, are housed within the assembled combination of the split compressor case 80, shown alone in FIG. 6, and the full hoop impeller shroud 84, shown alone in FIG. 7.

An impeller 150 of the radial compressor portion 152 is then captured between surfaces 154, 156 of the transition disk 130 and a second rotor backbone portion 158, respectively. In the illustrated embodiment, the second stop surface comprises the surface 154, although as noted above, the second stop surface may comprise any surface. A fastener 170, which may comprise a spanner nut, includes threads that interengage with threads of the tie bolt 129. The fastener 170 is threaded onto the tie bolt 129 until the fastener 170 engages an aft end 172 of second rotor backbone portion 154. The fastener 170 may then be tightened to a torque magnitude resulting in application of an axial force magnitude the same or different than the torque magnitude and the force magnitude, respectively, exerted by the fastener 140 so that the various elements are held in place.

The thus-assembled elements are assembled with other elements to complete the assembly of the entire rotating machinery.

INDUSTRIAL APPLICABILITY

In summary, a tie bolt construction and a method of assembling same clamp rotor stacks axially and provide a minimum continuous compressive load on the system throughout transient operation. A forward rotor portion is separated from an aft rotor portion with a space therebetween for a static structure, where one tie bolt is used to secure both forward and aft rotor portions together. The load is transferred through the rotor system through use of a fastener (in the illustrated embodiment a spanner nut) threaded to the tie bolt on one end and an axial face of the rotor stack on the other end. A mid-tie bolt fastener (again in the illustrated embodiment a spanner nut) is used to secure the forward rotor portion and allow for removal of the aft rotor portion. An aft tie bolt fastener (once again in the illustrated embodiment a spanner nut) secures the aft rotor portion to the forward rotor portion using the single tie bolt. Described herein is a method of using multiple fasteners of the same or different types on the same tie bolt to clamp multiple different rotor portions (or sub modules) of the rotor assembly. The rotor system desirably includes locations within the rotor backbone in close proximity to the tie bolt, which creates the space for the fastener load face. In addition, at the other end opposite the fastener locations, there is a stop surface (e.g., a shoulder) on the tie bolt for the rotor stack to load against. A mid-rotor system support comprising a radial pilot ties a rotor backbone and tie bolt together, thus improving the rotor dynamic characteristics of the system by alleviating tie bolt rotor dynamic modes in the operating range of the rotating machinery.

The primary embodiment shows a compressor system rotor that comprises a multi-stage axial compressor portion in series with a single stage radial compressor portion and a method of assembling a rotor. Due to the use of a split compressor case design the axial compressor portions could be stacked and loaded through the tie bolt separate from the rest of the system. However, the further desire to use a full hoop or 360° impeller shroud for the radial compressor portion presents an assembly challenge. Specifically, the 360° nature of the shroud prevented the entire rotor stack (i.e., axial and radial portions) from being completed as a unit. The solution described herein is to load the axial compressor stack with the mid-fastener, install the split compressor case, install the 360° impeller shroud, install the radial compressor portion, and load the aft fastener to complete the rotor assembly. In addition to providing a solution to the assembly challenge, the radial pilot is included between the rotor backbone and the tie bolt in the mid-fastener location that obtains the dynamic operation advantage noted above. □

A second embodiment may comprise a completely axial compressor system that requires a static structure while a third embodiment could comprise a turbine system that requires a static structure within the rotor train. Methods of assembling such components are also contemplated. Other embodiments are possible as noted above.

The present structure and method allow removal of the aft portion of the rotor stack without the concern of "unseating" radial pilots in the forward portion of the rotor stack. Radial pilots may be provided between each of the axial compressor stages of an engine and the load put on each portion of the stack, approximately tens of thousands of pounds, may cause the tie bolt to stretch. Stretching of the tie bolt develops particular vibration characteristics for each loaded portion of the stack. However, the load put on each portion does not need to be disturbed to remove or perform maintenance on another portion of the rotor stack. Thus, the stretch of the tie bolt and the vibration characteristics derived after the initial load is applied to a portion of the rotor stack do not need to be re-observed if another portion is removed. Further, the present structure allows a fixed support to be disposed in the middle of a long thin tie bolt to provide a rotor dynamic benefit for the tie bolt modal response. Still further, the structure described herein allows for two different torque values to be applied to the same stack as required by the system. Specifically, there could be a situation where the rotor is load limited in one area yet a higher load is required in another area. The rotor stack is modularized.

Still further, the present structure and method provide a tight packaging option for areas in small machines where standard bolted joints or spline interfaces are difficult to package. The present structure and method reduce concerns of load loss through the entire rotor system due to assembly friction.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A rotor structure for rotating machinery, comprising:

first and second rotor portions;

a tie bolt having a first stop surface at a first axial location wherein the first rotor portion is disposed on the tie bolt in abutment with the first stop surface;

a fastener disposed on the tie bolt at a second axial location spaced from the first axial location to exert a force on the first rotor portion and capture the first rotor portion on the tie bolt between the first and second axial locations; and a fixed split case assembled about the first rotor portion after the first rotor portion is captured on the tie bolt and before the second rotor portion is secured on the tie bolt and a full hoop impeller shroud placed about the tie bolt before the second rotor portion is secured on the tie bolt;

wherein the second rotor portion is disposed on the tie bolt in abutment with a second stop surface spaced from the first stop surface.

2. The rotor structure of claim 1, wherein the fastener exerts a first force magnitude on the first rotor portion and further including a further fastener disposed on the tie bolt in abutment with the second rotor portion and exerting a second force magnitude on the second rotor portion different than the first force magnitude.

3. The rotor structure of claim 1, wherein the tie bolt and the fastener include interengaging threads and wherein the fastener is threaded onto the tie bolt until the fastener engages the first rotor portion and is tightened to a first torque magnitude and further including a further fastener threaded onto the tie bolt until the further fastener engages the second rotor portion and is tightened to a second torque magnitude different than the first torque magnitude.

4. The rotor structure of claim 1, wherein the second stop surface is disposed on the fastener.

5. The rotor structure of claim 1, wherein the first rotor portion comprises an axial compressor member and the second rotor portion comprises a radial compressor member.

6. The rotor structure of claim 1, further including a support coupled to the tie bolt at a location proximate the second axial location.

7. A rotor structure for rotating machinery, comprising:

a tie bolt having a first stop surface at a first axial location;

a first rotor portion disposed on the tie bolt in abutment with the first stop surface;

a first fastener disposed on the tie bolt at a second axial location spaced from the first axial location, and exerting a force on the first rotor portion to engage the first rotor portion and to capture the first rotor portion on the tie bolt between the first and second axial locations, wherein the first fastener includes a second stop surface;

a second rotor portion disposed on the tie bolt in abutment with the second stop surface;

a fixed split case assembled about the first rotor portion after the first rotor portion is disposed on the tie bolt and before the second rotor portion is disposed on the tie bolt and a full hoop impeller shroud placed about the tie bolt before the second rotor portion is disposed on the tie bolt;

a second fastener disposed on the tie bolt at a third axial location spaced from the first and second axial locations and engaging the second rotor portion to capture the second rotor portion on the tie bolt between the second and third axial locations; and a support coupled to the tie bolt proximate the second axial location.

8. The rotor structure of claim 7, wherein the first fastener exerts a first force magnitude on the first rotor portion and the second fastener exerts a second force magnitude on the second rotor portion different than the first force magnitude.

9. The rotor structure of claim 8, wherein the first rotor portion comprises an axial compressor member and the second rotor portion comprises a radial compressor member.

10. The rotor structure of claim 7, wherein the tie bolt, the first fastener, and the second fastener include interengaging threads.

11. A method of assembling a rotor structure for rotating machinery, the method comprising the steps of:

assembling a first rotor portion on a tie bolt in abutment with a first stop surface at a first axial location on the tie bolt;

assembling a fastener on the tie bolt at a second axial location spaced from the first axial location to apply a force on the first rotor portion and capture the first rotor portion on the tie bolt between the first and second axial locations;

assembling a fixed split case about the first rotor portion after the step of assembling the first rotor portion on the tie bolt and before securing a second rotor portion on the tie bolt;

assembling a full hoop impeller shroud about the tie bolt before the second rotor portion is secured on the tie bolt; and securing the second rotor portion on the tie bolt in abutment with a second stop surface spaced from the first stop surface.

12. The method of claim 11, wherein the step of securing includes the steps of providing a further fastener and assembling the further fastener on the tie bolt in abutment with the second rotor portion.

13. The method of claim 12, wherein the step of assembling the further fastener on the tie bolt comprises the step of threading the further fastener on the tie bolt until the further fastener engages the second rotor portion.

14. The method of claim 11, wherein the step of assembling the fastener comprises the steps of threading the fastener onto the tie bolt until the fastener engages the first rotor portion.

15. The method of claim 11, wherein the second stop surface is disposed on the fastener.

16. The method of claim 11, wherein the first rotor portion comprises an axial compressor member and the second rotor portion comprises a radial compressor member.

17. The method of claim 16, including the further step of tightening the fastener against the first rotor portion to a particular torque.

18. The method of claim 11, wherein the step of assembling the fastener on the tie bolt comprises the step of tightening the fastener against the first rotor portion to a first torque magnitude and the step of securing the second rotor portion on the tie bolt comprises the step of tightening a further fastener against the second rotor portion to a second torque magnitude different than the first torque magnitude.

19. The method of claim 11, including the further step of supporting the tie bolt at a location proximate the second axial location.

* * * * *